US007552849B2

(12) United States Patent
Gouldson

(10) Patent No.: US 7,552,849 B2
(45) Date of Patent: Jun. 30, 2009

(54) SIDE-SIZER FOR WIRE HOOK HANGERS

(75) Inventor: Stanley Gouldson, Northport, NY (US)

(73) Assignee: Spotless Plastics Pty. Ltd., Victoria (AU)

( * ) Notice: Subject to any disclaimer, the term of this patent is extended or adjusted under 35 U.S.C. 154(b) by 0 days.

(21) Appl. No.: 11/373,405

(22) Filed: Mar. 10, 2006

(65) Prior Publication Data

US 2006/0213939 A1 Sep. 28, 2006

Related U.S. Application Data

(60) Provisional application No. 60/661,587, filed on Mar. 14, 2005.

(51) Int. Cl.
*A41D 27/22* (2006.01)

(52) U.S. Cl. ..... 223/85; 40/322

(58) Field of Classification Search ..... 223/85, 223/87, 88, 92, 95, 98; 40/322; 211/85.3, 211/113; 248/339, 340
See application file for complete search history.

(56) References Cited

U.S. PATENT DOCUMENTS

| | | | | | |
|---|---|---|---|---|---|
| 1,389,266 | A | * | 8/1921 | Newton | 40/322 |
| 1,575,775 | A | * | 3/1926 | Lesser | 40/322 |
| 1,682,106 | A | * | 8/1928 | Banks | 40/322 |
| 2,690,863 | A | * | 10/1954 | Adelman | 40/322 |
| 2,861,726 | A | * | 11/1958 | Whyte | 223/92 |
| 3,535,808 | A | * | 10/1970 | Morrish | 40/322 |
| 3,790,044 | A | * | 2/1974 | Verdile | 223/86 |
| 3,898,754 | A | * | 8/1975 | Johansson | 40/322 |
| 4,017,990 | A | * | 4/1977 | Garrison | 40/322 |
| 4,045,899 | A | * | 9/1977 | Richardson | 40/322 |
| 4,123,864 | A | * | 11/1978 | Batts et al. | 40/322 |
| 4,137,661 | A | * | 2/1979 | Johansson | 40/322 |
| 4,198,773 | A | * | 4/1980 | Batts et al. | 40/322 |
| 4,322,902 | A | * | 4/1982 | Lenthall | 40/322 |
| 4,333,590 | A | * | 6/1982 | Princiotta | 223/85 |
| 4,679,340 | A | * | 7/1987 | Johansson | 40/322 |
| 4,881,836 | A | * | 11/1989 | Blanchard | 40/322 |
| 4,886,010 | A | * | 12/1989 | Stutzman | 223/85 |
| 5,381,938 | A | * | 1/1995 | Vasudeva | 223/85 |
| 5,499,466 | A | * | 3/1996 | House | 40/322 |
| 5,687,887 | A | * | 11/1997 | Bond et al. | 223/85 |
| 5,778,575 | A | * | 7/1998 | Deupree et al. | 40/322 |
| 5,962,834 | A | * | 10/1999 | Markman | 235/385 |
| 6,019,261 | A | * | 2/2000 | Morgan et al. | 223/96 |
| 6,035,570 | A | * | 3/2000 | Maglio | 40/673 |
| 6,330,969 | B1 | * | 12/2001 | Villaraut | 235/64.7 |

(Continued)

FOREIGN PATENT DOCUMENTS

| | | |
|---|---|---|
| DE | 29510218 | 9/1995 |

(Continued)

*Primary Examiner*—Gary L. Welch
*Assistant Examiner*—Nathan E Durham
(74) *Attorney, Agent, or Firm*—Scully, Scott, Murphy & Presser, P.C.

(57) ABSTRACT

A side-sizer for a garment hanger has a collar portion with a band configured to engage a wire hook of the hanger and an indicator portion pivotally connected to the collar portion. The indicator portion has means for retaining the indicator portion engaged with the hanger. The side-sizer exhibits indicia related to an item to be suspended from the hanger.

14 Claims, 2 Drawing Sheets

U.S. PATENT DOCUMENTS

| | | | | |
|---|---|---|---|---|
| 6,883,259 | B2 * | 4/2005 | Johansson | 40/322 |
| D506,620 | S * | 6/2005 | Leung et al. | D6/328 |
| D507,120 | S * | 7/2005 | Leung et al. | D6/328 |
| D510,198 | S * | 10/2005 | Willardson | D6/328 |
| 7,210,576 | B2 * | 5/2007 | Lam | 206/300 |
| 7,287,674 | B1 * | 10/2007 | Sutton et al. | 223/85 |
| 2002/0066757 | A1 * | 6/2002 | Lee | 223/85 |
| 2003/0205592 | A1 * | 11/2003 | Lam | 223/87 |
| 2004/0211796 | A1 * | 10/2004 | Misumi | 223/85 |
| 2006/0037981 | A1 * | 2/2006 | Dedo | 223/87 |

FOREIGN PATENT DOCUMENTS

| | | |
|---|---|---|
| DE | 29706051 | 12/1997 |

* cited by examiner

SIDE-SIZER FOR WIRE HOOK HANGERS

CROSS-REFERENCE TO RELATED APPLICATIONS

This application claims benefit under 35 U.S.C. § 119(e) of U.S. Provisional Application Ser. No. 60/661,587, entitled "Side-Sizer for Wire Hook Hangers", filed 14 Mar. 2005 by the present inventor and commonly assigned with the present application, the complete disclosure of which is hereby incorporated by reference for all purposes.

BACKGROUND OF THE INVENTION

1. Field of Invention

The present invention relates generally to the field of garment hangers, and more specifically to a side-sizer for use with a hanger having a wire metal hook.

2. Description of Related Art

In the area of retail garment sales, so-called Garment-On-Hanger (GOH) programs have become preferred to retailers. In a GOH program, garments are delivered to retail merchants already suspended from hangers, whereupon arrival at the retail location they may immediately be placed on display for sale. Formerly, retailers accomplished this task with labor provided at their own expense.

In particular, retailers have specified particular hangers or hanger characteristics among their several suppliers in order to achieve a visually pleasing uniformity on their sales floors. To this end, standards as to hanger size, shape, performance characteristics, etc., are maintained, for example, by organizations such as the Voluntary Inter-industry Commerce Standards Association (VICS). One particular standardized hanger feature is extremely popular across several hanger models, namely a turnable wire hook mated to a plastic hanger.

Additionally, and interrelated to the promulgation of GOH programs, retailers and their customers desire to have the hanger itself display some indicia regarding the item carried upon it. Categories of indicia could include manufacturer, material and price, but most notably for garments, their size. Various means for accomplishing this have been developed, including those disclosed in U.S. Pat. No. 5,884,422 to Marshal, et al., and U.S. Pat. No. 6,019,260 to Gouldson, both of which are commonly assigned with the instant application, among others. Popular among these are the type disclosed in the latter patent just mentioned, i.e., those that secure to the hanger adjacent the intersection of the hook and the hanger body to one side of the hook, appropriately called side-sizer tabs, or simply side-sizers; or lower neck sizers or indicators.

However, such side-sizers heretofore known in the art require that the hanger be specifically manufactured to accept the particular indicator. Various other indicators could be made universally adaptable, for example, those attached or surrounding the wire hook of the hanger. These generally are free to slide along the length of the wire hook, and ordinarily come to rest at the base of the hook adjacent the hanger body. However, these do not achieve the desired appearance afforded by a side-sizer.

BRIEF SUMMARY OF THE INVENTION

Therefore, in order to overcome these and other deficiencies in the prior art, provided according to the present invention is a size-sizer for a garment hanger having a collar portion with a band configured to engage a hook of the hanger and an indicator portion pivotally connected to the collar portion.

The indicator portion has means for retaining the indicator portion engaged with the hanger. The side-sizer exhibits indicia related to an item to be suspended from the hanger.

In further embodiments the side-sizer is unitarily formed from an injection-molded plastic, particularly polypropylene or K-resin, in which case the collar portion and indicator portion can be pivotally connected by a living hinge.

The indicator portion can include a retaining tab on a lateral face of the indicator portion for retaining it engaged with the hanger. The retaining tab can have at least one of an inward surface and an outward surface being angled relative to a transverse datum. Alternately or additionally, the indicator portion is maintained engaged with the hanger via a predetermined distance between two lateral faces of the indicator portion dimensioned to engage the hanger.

BRIEF DESCRIPTION OF THE DRAWINGS

These and other features, aspects and benefits of the present invention will be made apparent with reference to the following specification and accompanying drawings, where like reference numerals refer to like features across the several views, and wherein.

DETAILED DESCRIPTION OF THE INVENTION

Figure 1:
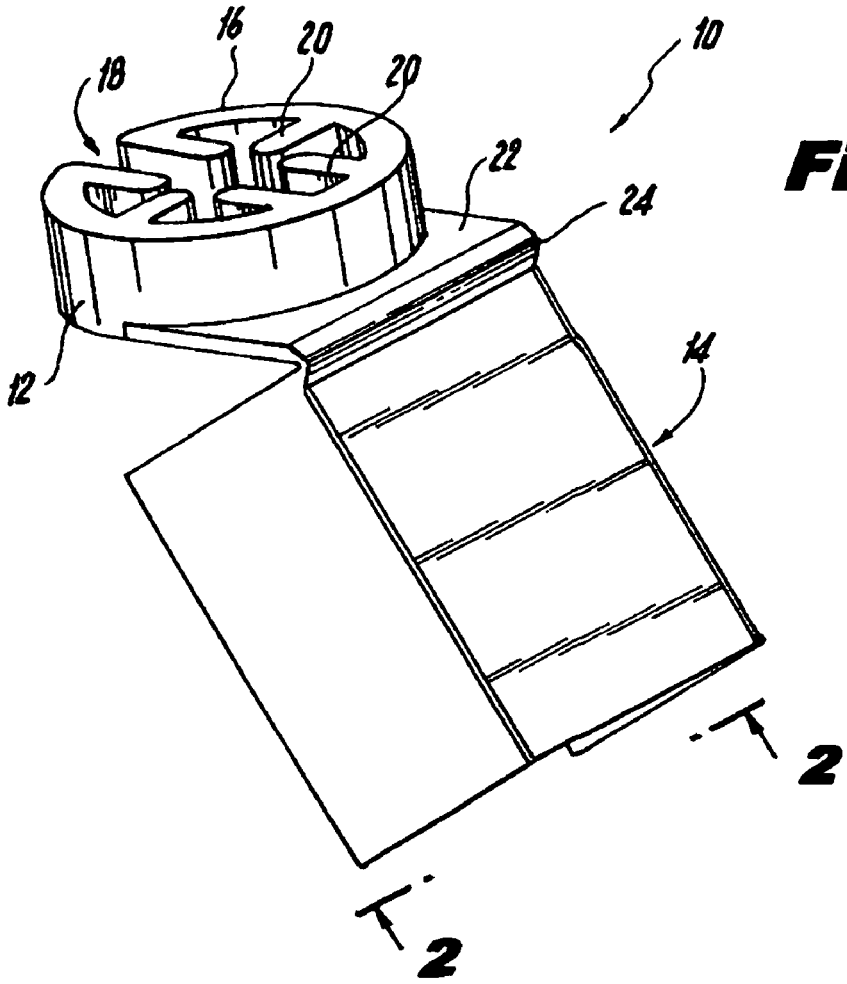
FIG. 1 illustrates a perspective view of a side-sizer according to the present invention.

Referring now to FIG. 1, shown in perspective view is a side-sizer, generally 10, according to an exemplary embodiment of the present invention. Side-sizer 10 constitutes generally, a collar portion 12, and an indicator portion 14. One skilled in the art will appreciate, however, that collar portion 12 may also serve at least part of an indicating function.

Collar portion 12 has a generally cylindrical band 16. The generally cylindrical band 16 can be circular, as in the illustrative embodiment, or another geometric cylindrical projection, including but not limited to rectangular, square, triangular, pentagonal, etc. The band 16 can have a discontinuity 18 to facilitate mounting to a hanger by admitting a wire hook. Collar portion 12 also has a plurality of substantially radial inwardly directed projections 20. At their mutual inward ends, projections 20 engage the wire hook of the hanger. Extending outwardly from one side of the collar portion 12 is a shelf 22 that is attached to and carries indicator portion 14.

Indicator portion 14 is attached to collar portion 12 at shelf 22 through a hinge 24. More specifically, hinge 24 can be a living hinge formed integrally of the same material as tab portion 14 and/or collar portion 12. Alternately, indicator portion 14 may be attached to collar portion 12 without any hinge 24, and at any predetermined angle, as suitable for an intended application.

Figure 2:
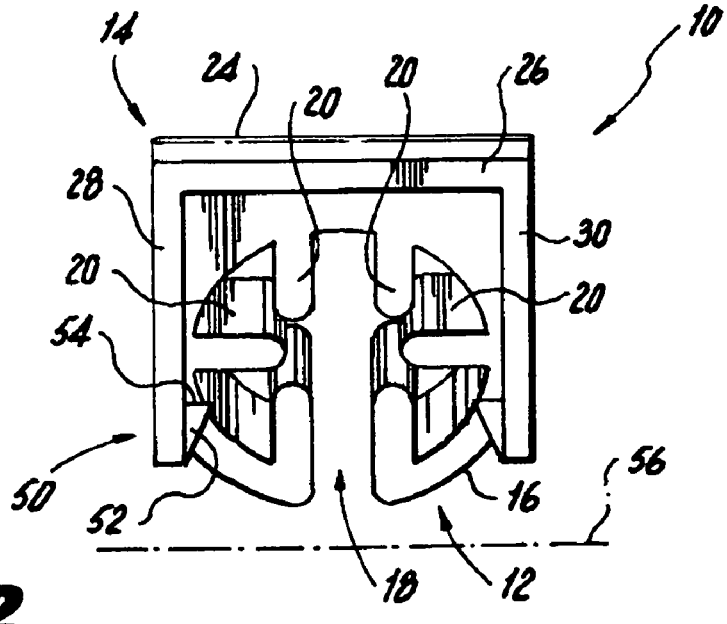
FIG. 2 illustrates an axial end view of the side-sizer, taken along line 2-2 of FIG. 1.

Referring now to FIG. 2, shown is an axial end view of indicator portion 14. The cross-sectional shape can be generally described as "C-channel", though other shapes are equally suitable, including for example N-channel, U-channel, V-channel, among others. In the exemplary embodiment, indicator portion 14 is C-channel in cross-section, including an outward face 26, and complementary first lateral face 28 and a second lateral face 30. In an N-channel embodiment, the cross-section would be largely similar to the C-channel as shown, though having longer lateral faces in relation to the outward face, generally resembling a lower-case "n". In a U-channel embodiment, the rounded portion of the u would replace outward face 28, while in a V-channel embodiment two lateral faces would intersect obviating an outward face. Other configurations will be apparent to those skilled in the art in light of the instant disclosure, and the shape of the indicator portion 14 is not limited to those described. In any event, the indicator portion 14 can further open along at least a portion of an inward surface, generally opposite the outward face 26, in order to engage a hanger to which the side-sizer 10 is mounted.

Figure 3:
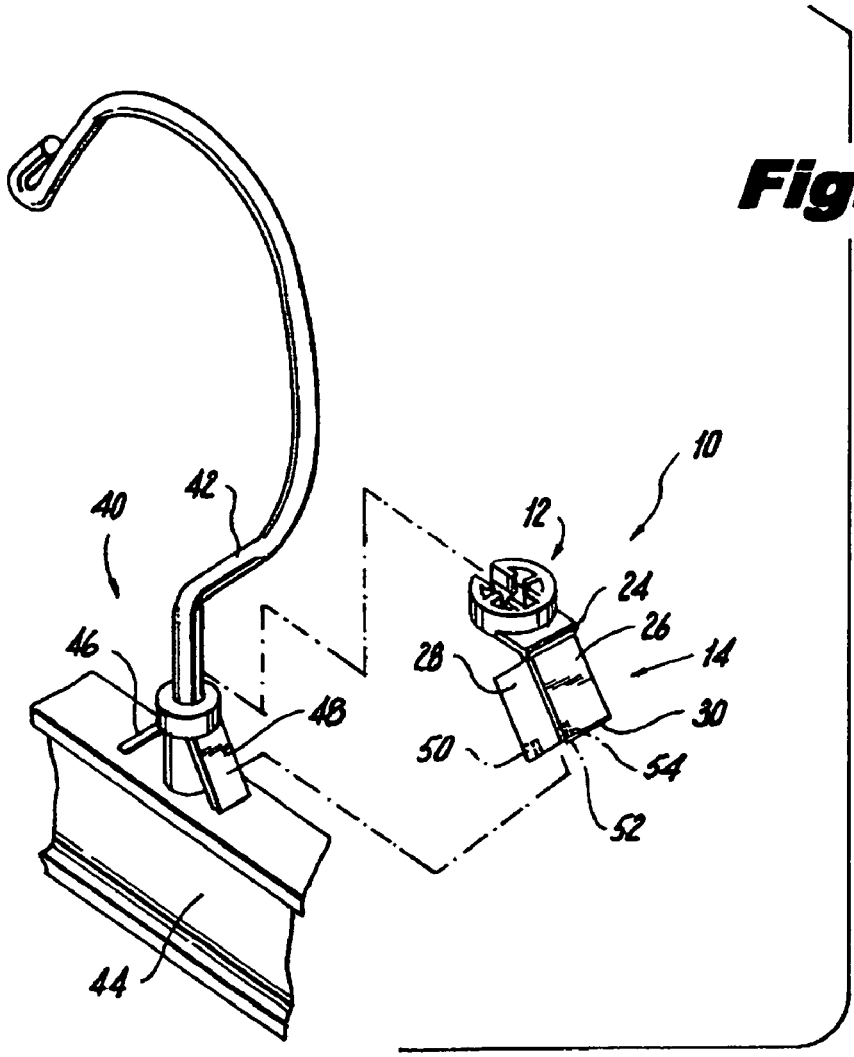
FIG. 3 illustrates a further embodiment of the side-sizer according to the present invention in proximity with the hanger to which it is to be placed.

Referring now to FIG. 3, shown is a side-sizer 10 in one particular application contemplated, i.e., a molded plastic hanger having a metal hook. The hanger, generally 40 (partially shown in cutaway), has a metal hook 42, which is attached to hanger body 44 via a triangular or trapezoidal (as viewed from a lateral side) reinforcement 46. The hanger 40 generally, and in particular reinforcement 46 includes one or more flanges 48. In the embodiment shown in FIG. 3, side-sizer 10*a* omits shelf 22, and indicator portion 14 is directly connected to collar portion 12 at hinge 24. Side-sizer 10*a* also includes a retaining tab 50 extending inward of either or both lateral faces 28, 30. Retaining tab 50 may be coextensive with lateral face 28 or 30, or both, or may be intermittent anywhere along the length of either face, irrespective of the length, size, shape, or even presence of a retaining tab 50 on the complementary face. Retaining tab 50 may be carried on an inward surface of lateral face 28 or 30, or at an end of the lateral face 28, 30, opposite outward face 26.

Referring again to FIG. 2, retaining tabs 50 have an inward surface 52 and outward surface 54, either or both of which may be sloped relative to a lateral datum 56. In the exemplary embodiment shown, retaining tabs 50 have a generally flat outward surface 54 relative to transverse datum 56, which provides additional resistance to removal. Inward surface 52 is sharply sloped relative to transverse datum 56, which reduces resistance and aids in ease of engagement with flange 48. Inversely, where outward surface 54 sloped downward, considered as having distal point of tab 50 below the point of attachment to lateral face 28, resistance to removal would be reduced. Similarly, a reduced or eliminated upward slope of inward surface 52 would increase resistance to engagement with flange 48.

When indicator portion 14 is urged into engagement with flange 48, the retaining tabs 50 tabs urge either or both lateral faces 28, 30 away from one another. Continued inward pressure on indicator portion 14 moves retaining tabs 50 beyond flange 48, releasing transverse pressure on lateral faces 28, 30, which return to their previous configuration. Thereafter, retaining tabs 50 cooperate with flange 48 to retain the indicator portion 14 engaged with the hanger 40, and more specifically reinforcement 46. Alternately or additionally, the distance between lateral faces 28, 30 may be selected so that these continually engage flange 48 and retain the indicator portion 14 engaged with the hanger 40.

In an exemplary embodiment, side-sizer 10 is integrally formed of a plastic material, more specifically, an injection molded plastic. The plastic can be flexible to accommodate pivoting between the collar portion 12 and the indicator portion 14 where hinge 24 is a living hinge, and to accommodate resilient flexure of lateral faces 28, 30 for engagement with the hanger. Materials contemplated that satisfy this criterion of flexibility include, without limitation, polypropylene in its various forms, and K-resin in its various forms, among others.

Figure 4:
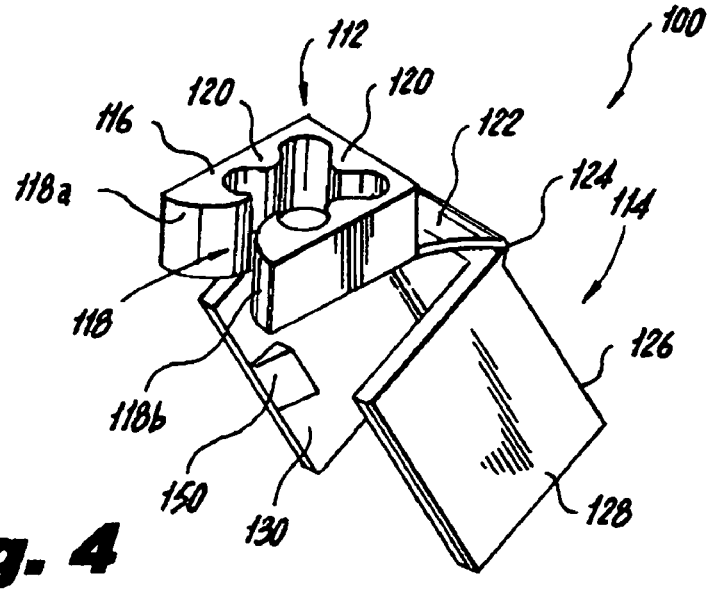
FIG. 4 illustrates an alternate embodiment of the side-sizer according to the present invention.

Referring now to FIG. 4, shown in perspective view is a side-sizer, generally 100, according to an alternate embodiment of the present invention. Side-sizer 100 is comprised generally of a collar portion 112, and an indicator portion 114. Band 116 is a generally square cylindrical projection, having a discontinuity 118 to facilitate mounting to a hanger by admitting a wire hook. Moreover, band 116 provides sloped surfaces 118*a*, 118*b*, adjacent to discontinuity 118 to guide the wire hook upon insertion. Collar portion 112 also has a plurality of substantially radial inwardly directed projections 120. Indicator portion 114 is attached to collar portion 112 at shelf 122 through a hinge 124. Indicator portion 114 includes an outward face 126, and complementary first lateral face 128 and second lateral face 130. A retaining tab 150 extends inward of lateral face 130. The function of side-sizer 100 will be seen as generally similar to the previous embodiment.

Side-sizers 10, 100, or any parts thereof, can be configured to carry any indicia selected in advance to correspond to the item to be suspended from the hanger. The indicia can have the form of numbers, letters or symbols either applied to the side-sizer 10 and/or formed into it. Alternately or additionally the color, size, shape or mere presence of the side-sizer 10 itself may be the indicia.

The present invention has been described with respect to certain exemplary embodiments. Certain alterations and/or modifications will be apparent to those skilled in the art, in light of the instant disclosure, without departing from the spirit or the scope of the invention. These embodiments are offered as merely illustrative, and not limiting, on the scope of the invention, which is defined solely with reference to the following appended claims.

The invention claimed is:

1. A side sizer for displaying indicia concerning a garment, the side sizer configured to affix to a metal hook type garment hanger, the hanger having a metal hook portion and a hanger portion that includes a post extending from a hanger body, the post bounded on lateral sides by flanges, the side sizer comprising;

a. a collar portion; and b. a body portion pivotally attached to the collar portion by a hinge;

the collar portion comprising a band provided with a slot in a lateral band side, the slot configured to receive a wire hook of a garment hanger, and a plurality of fingers arrayed about the perimeter of the band, the fingers extending inward of the band, the fingers provided with terminal free ends that in concert with each other are configured to retain the metal hook in a free space existent between the terminal free ends;

the body portion comprising a cavity, sized and arranged to receive a hanger flange in an interior of the cavity, wherein the cavity is provided on an interior thereof with means for retaining the hanger flange engaged in the cavity, wherein the side sizer displays information concerning a garment on a portion thereof.

2. The side sizer of claim 1 wherein the collar portion is comprised of a cylindrical band.

3. The side sizer of claim 1 wherein the collar portion is located upon a shelf in pivotal connection with the body portion.

4. The side sizer as set forth claim 1 wherein the means for retaining the hanger flange engaged in the cavity is at least one protrusion positioned to create an interfering relationship with the hanger flange.

5. The side sizer as set forth in claim 1 wherein a plurality of panels is arranged to form the cavity, which cavity is closed on three sides and open on a fourth side.

6. The side sizer of claim 5 wherein the cavity is formed by three panels, wherein a first panel and a second panel oppose each other across a third panel joined to each of the first and second panels.

7. The side sizer of claim 6 wherein the means for retaining the hanger flange engaged in the cavity are protrusions provided on each of the first and second panels on interior sides thereof the protrusions positioned to create an interfering relationship with the hanger flange.

8. A combination of a wire hook hanger and a side sizer, the combination comprising:

A) a wire hook hanger comprising, 1. a hanger body;
2. a wire hook, retained within a projection that extends from the hanger body;
3. first and second flanges that extend at an acute angle from the hanger body to the projection, with the projection positioned between the first and second flange; and B) a side sizer comprising;

1. a collar portion;
2. a body portion pivotally attached to the collar portion by a hinge;

the collar portion comprising a band provided with a slot in a lateral band side, the slot configured to receive the wire hook of the hanger, a plurality of fingers arrayed around the perimeter of the band, the fingers extending inward of the band, the fingers provided with terminal free ends that in concert with each other are configured to retain the wire hook in a free space existent between the terminal free ends;

the body portion comprising a cavity sized and dimensioned to receive a hanger flange;

wherein the cavity is provided on an interior thereof with means for retaining the hanger flange engaged in the cavity; and wherein the side sizer displays information concerning a garment on a portion thereof.

9. The side sizer of claim 8 wherein the collar portion is comprised of a cylindrical band.

10. The side sizer of claim 8 wherein the collar portion is located upon a shelf, in pivotal connection with the body portion.

11. The side sizer as set forth claim 8 wherein the means for retaining the hanger flange engaged in the cavity is at least one protrusion positioned to create an interfering relationship with the hanger flange.

12. The side sizer as set forth in claim 11 wherein a plurality of panels is arranged to form the cavity, which cavity is closed on three sides and open on a fourth side.

13. The side sizer of claim 12 wherein the cavity is formed by three panels, wherein a first panel and a second panel oppose each other across a third panel joined to each of the first and second panels.

14. The side sizer of claim 13 wherein the means for retaining the hanger flange engaged in the cavity are protrusions provided on each of the first and second panels on interior sides thereof, the protrusions positioned to create an interfering relationship with the hanger flange.

* * * * *